United States Patent [19]

Kokkonen et al.

[11] Patent Number: 4,891,170

[45] Date of Patent: Jan. 2, 1990

[54] NOZZLE ASSEMBLY

[75] Inventors: Kari Kokkonen, Tampere; Martti Lethimäki, Sarkola; Seppo Tuominiemi, Pirkkala; Hannu Alppi, Tampere, all of Finland

[73] Assignee: Oy Tampella Ab, Tampere, Finland

[21] Appl. No.: 257,906

[22] Filed: Oct. 14, 1988

[30] Foreign Application Priority Data

Oct. 15, 1987 [FI] Finland ..... 874544

[51] Int. Cl.[4] ..... B01F 3/04

[52] U.S. Cl. ..... 261/116; 261/117; 239/600

[58] Field of Search ..... 261/116, 117; 239/600

[56] References Cited

U.S. PATENT DOCUMENTS

| | | | |
|---|---|---|---|
| 2,561,432 | 7/1951 | Tranter | 261/116 |
| 2,687,614 | 8/1954 | Goddard | 261/117 |
| 3,113,168 | 12/1963 | Kinney | 261/117 |
| 3,842,615 | 10/1974 | Reigel et al. | 261/116 |
| 3,912,469 | 10/1975 | Ewan et al. | 261/117 |
| 3,918,639 | 11/1975 | Binasik | 239/600 |
| 3,946,949 | 3/1976 | Rossi | 239/600 |
| 4,073,832 | 2/1978 | McGann | 261/117 |
| 4,083,932 | 4/1978 | Muraco et al. | 261/116 |
| 4,165,040 | 8/1979 | Beacham et al. | 239/600 |
| 4,257,559 | 3/1981 | Noren | 239/600 |

FOREIGN PATENT DOCUMENTS

| | | | |
|---|---|---|---|
| 2903754 | 8/1980 | France | 261/117 |

*Primary Examiner*—Tim Miles

*Attorney, Agent, or Firm*—Pollock, Vande Sande & Priddy

[57] ABSTRACT

A nozzle assembly includes at least one nozzle (1) for the injection of liquid moistening medium into a flow of flue gas, especially in view of cooling the flue gas, and a body (2) for directing the moistening medium to the nozzle. Nozzle (1) and body (2) are essentially disposed in a flue-gas flow duct or the like. In the flue-gas flow duct is fitted a housing (3) which essentially surrounds nozzle (1) and body (2). Housing (3) ia provided with an an aperture (10), which can be closed by a closing means (9) and through which a jet of moistening medium passes into a flow of flue gas.

23 Claims, 5 Drawing Sheets

NOZZLE ASSEMBLY

BACKGROUND OF THE INVENTION

The present invention relates to a nozzle assembly, comprising at least one nozzle for the injection of a liquid moistening medium into a flue-gas flow especially for cooling the flue gas and a body for delivering the moistening medium to the nozzle, the nozzle and body being essentially disposed in a flue-gas flow duct or the like.

Cooling of a flue-gas close to the dew point is effected by injecting into a flue-gas flow in a flue-gas moistening reactor some flue-gas moistening medium, generally water, which contains minor amounts of additives. The presently available assemblies employing a generally tubular body, disposed in a flue-gas flow duct and fitted with at least one nozzle are not advantageous. Flue gases contain solids such as fly ash or flue-dust and Ca-compounds, which lead to the soiling and blocking of nozzles. This problem is particularly pronounced in cooling a flue gas whenever the purpose is to cool the gases close to the dew point. Then, the following reasons may cause the soiling of nozzles and a body:

- a flow of flue gas creates eddies (back-eddies) around a pipework with a result that solids and water drift into and get stuck on a pipe-work,
- the water in flue gas condenses on cold nozzle tubes with a result that solids stick to the surface of a moist tube, and
- direct splashing of water from nozzles onto a body with a result that the surfaces get wet and soiled.

Another problem is a corrosion hazard of nozzles and a body as flue gases often contain sulphur whose reactions at temperatures close to the dew point cause acid corrosions.

In the flue-gas flow duct of a flue-gas moistening rector there occures slagging (accumulation of solids on the walls of a flow duct) also in the upper portions of a reactor, which is why the reactor must be periodically mechanically cleaned for example at 8 hour intervals. The falling pieces of slag result in a hazard of damaging the nozzle assembly as they hit it.

A satisfactory solution has not been found to the above problems in the presently available nozzle assemblies.

SUMMARY OF THE PRESENT INVENTION

An object of this invention is to provide a nozzle assembly structure which eliminates the prior art problems and at the same time allows to accomplish certain novel preferred constructive and functional features. In order to achieve this object, in the nozzle assembly of the invention a nozzle and a body are substantially enclosed in a housing provided with an aperture for passing a jet of moistening medium into a flow of flue gas. A first solution is to insulate a body in which the moistening medium is carried to nozzles. This prevents the adhesion of solids to the body, direct splashing of water on the body, the formation of condensing water as well as corrosion hazards. Secondly, the housing can be designed so as to guide the flue gas without the formation of eddies past the nozzle and body. Thirdly, the housing provides a mechanical protection to the nozzle and body during the cleaning of a moistening reactor. Fourthly, the construction offers a possibility of maintaining, repairing and cleaning the body, nozzles and housing interiors during operation.

The invention will now be described in more detail in the following specification with reference made to the embodiment shown in the accompanying drawings wherein:

DETAILED DESCRIPTION OF THE PREFERRED EMBODIMENT(s)

Figure 1:
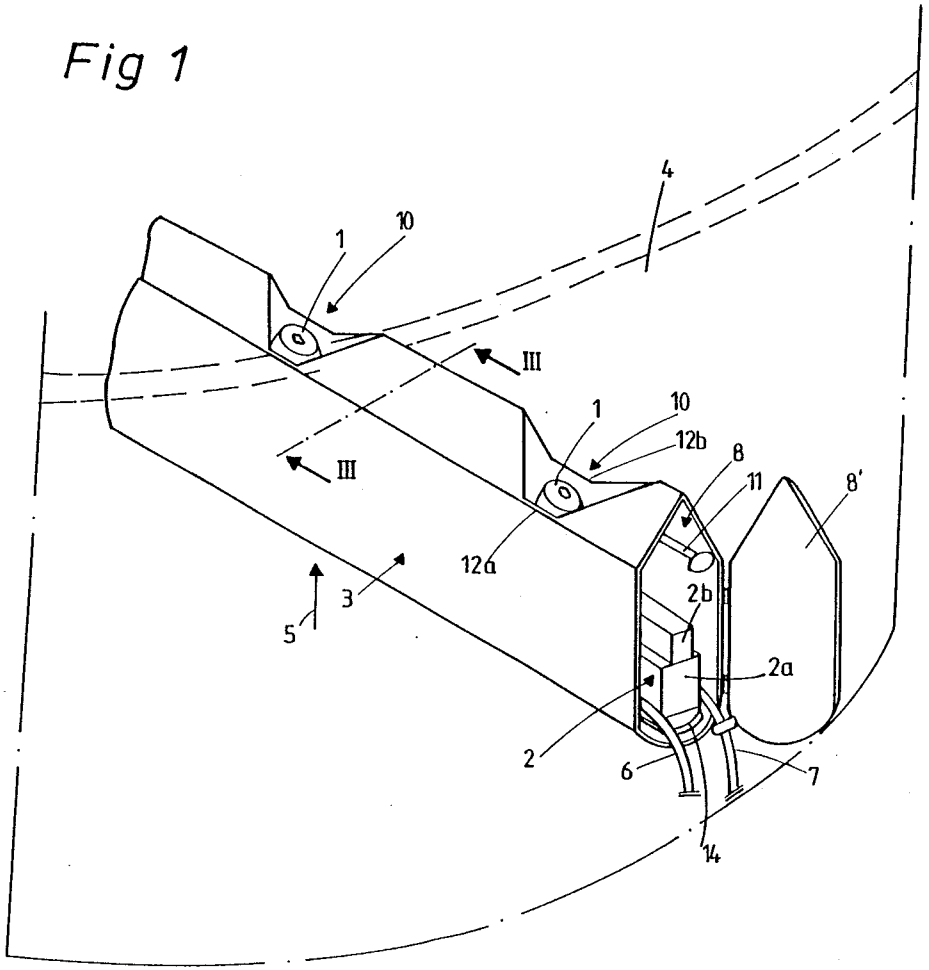
FIG. 1 shows schematically a perspective view of one embodiment of a nozzle assembly of the present invention in an operating position.
Figure 2:
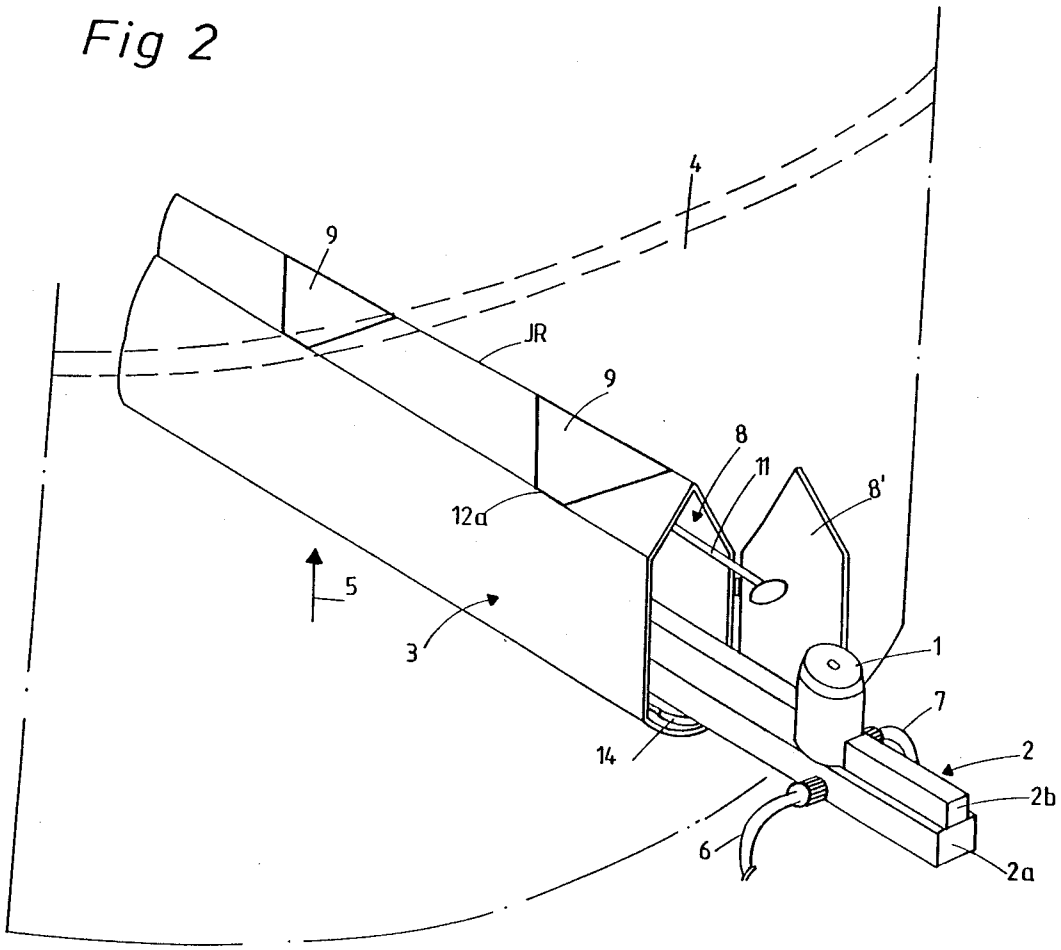
FIG. 2 shows also schematically a perspective view of a nozzle assembly in a position in which the body is partially withdrawn from within the housing.

A nozzle assembly shown in the drawing includes the following main components: at least one nozzle 1, or a plurality of them, a body 2 for passing a moistening medium to each nozzle 1 and a housing 3 or the like which surrounds nozzle 1 and body 2 and is fastened to a flow-duct wall 4 shown referentially in FIGS. 1 and 2. The main direction of flow of flue gas is designated by reference numeral 5.

Nozzles 1, a plurality of them in the embodiment shown, are fastened at predetermined intervals to an elongated body 2, comprising a water tube **2*a* and a pneumatic tube 2*b*. The components 2*a* and 2*b* are through the intermediary of flexible hoses 6, 7 connected to respective distributing blocks (not shown). Thus, nozzles 1 are in this case pneumatic-spreading nozzles, each of which is supplied with a mixture of compressed air and water through components 2*a* and 2*b***.

At the junction of housing 3 and the wall of flue-gas flow duct 4 is an opening 8, which can be closed preferably by a door 8' and through which nozzles 1 and body 2 are inserted into housing 3 and can be withdrawn from within that housing. Body 2 along with its nozzles 1 is placed inside the housing by pushing in the longitudinal direction of housing 3. The internal housing surface can be provided with suitable guideways (not shown). At the location of each nozzle 1 the housing 3 is provided with an aperture 10 fitted with a closing means 9. In the operating position of the nozzle assembly, the closing means 9 are opened so as to bring a jet of moistening medium into a flow of flue gas from within housing 3. When the operation of a nozzle assembly is stopped, for example for maintenance, the closing means 9 can be shut for closing the apertures 10 which are aligned with nozzles 1 of housing 3. This can be effected for example by means of a rod 11 or the like, which extends lengthwise of housing 3 and is fastened to each closing means 9. Rod 11 can be manipulated from outside the flue-gas flow duct for moving closing means 9 lengthwise of the housing. Another alternative for effecting the movement of such closing means is to link the operation of closing means 9 to the movement of nozzles 1 and body 2, whereby a member mounted on the nozzles and/or the body shifts each closing means 9 to an opened or closed position during the movement of nozzles 1 and body 2 relative to housing 3. This alternative has not been illustrated in the drawing but for a skilled person it is obviously quite simple to build such alternative construction according to described operation.

Figure 3:
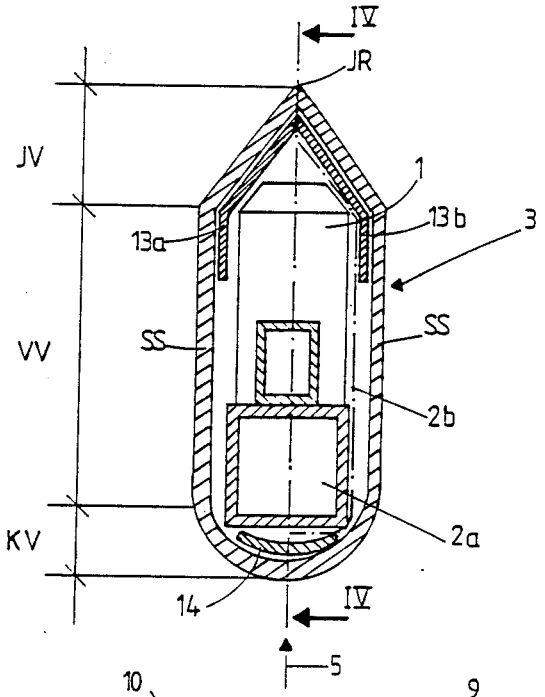
FIG. 3 is a section taken along line III—III in FIG. 1.

FIG. 3 depicts the cross-sectional shape of the housing. It is aerodynamically designed, so that the contact zone KV of a flue-gas flow has a substantially arcuate cross-section and the trailing zone JV has a cross-section substantially tapering to a trailing edge JR. Housing 3 can be constructed in such a manner that trailing zone JV begins immediately downstream of contact zone KV but in the illustrated embodiment the housing includes between contact zone and trailing zone an intermediate zone VV, wherein the side walls SS of a housing are substantially parallel as seen in the cross-section of housing 3. The side walls extend substantially in the same direction as the main direction of a flue-gas flow (arrow 5). The cross-sectional shape of housing 3 is preferably symmetrical relative to the connecting line between the center of contact zone KV and trailing edge JR.

Figure 4:
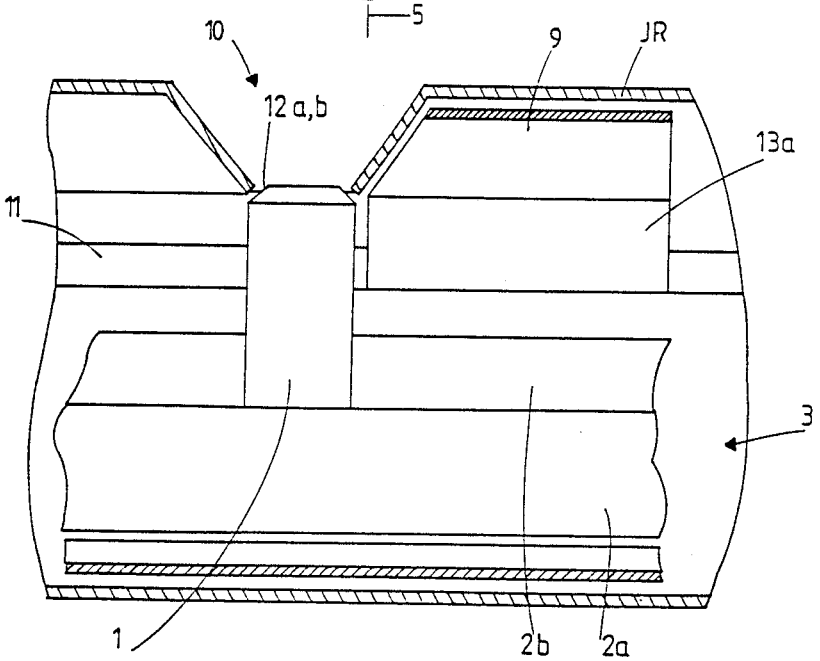
FIG. 4 is a section taken along line IV—IV in FIG. 3 and FIGS. 5–7 show examples of possible dispositions of the nozzle assembly in a flow duct.

Apertures 10 are located at trailing zone JV so that two opposite edges 12*a*, 12*b* of the aperture, extending lengthwise of housing 3, are located at the junction of trailing zone JV and intermediate zone VV. Each aperture 10 flares from the ends of the edges 12*a*, 12*b* towards trailing edge JR, as seen from the side of housing 3. As shown particularly in FIG. 3 and 4, the closing means 9 are fitted inside housing 3. They are designed to conform with the cross-section of trailing zone JR and include extensions 13*a*, 13*b* at side walls SS. The bottom of housing 3 is also provided with a separate, possibly withdrawable slag chute 14.

In the illustrated embodiment, the jets of moistening medium are sprayed downstream relative to a flow of flue gas. In certain cases, it may even be possible to effect spraying substantially counter to a flow of flue gas. All above alternatives are within the scope of the present invention.

Since there is normally vacuum in a flue-gas flow duct and since the housing is in contact with ambient atmospheric pressure through opening 8, it is obvious that accumulation of solids inside the housing cannot occur.

Figure 5:
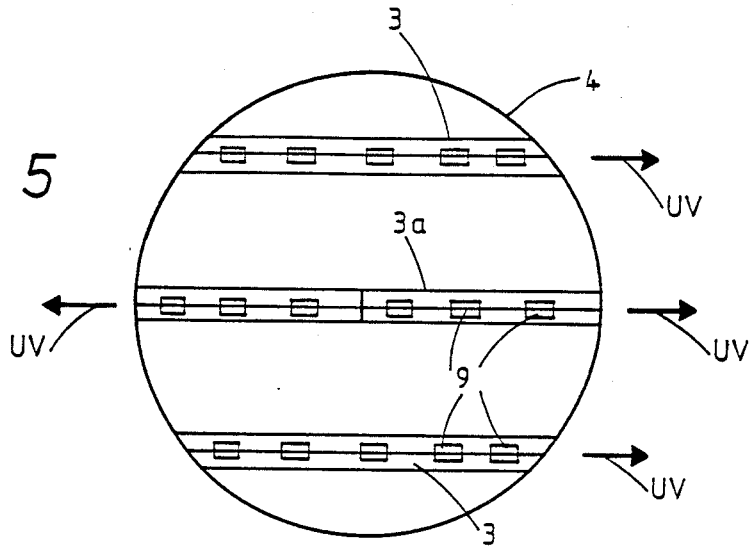
Figure 6:
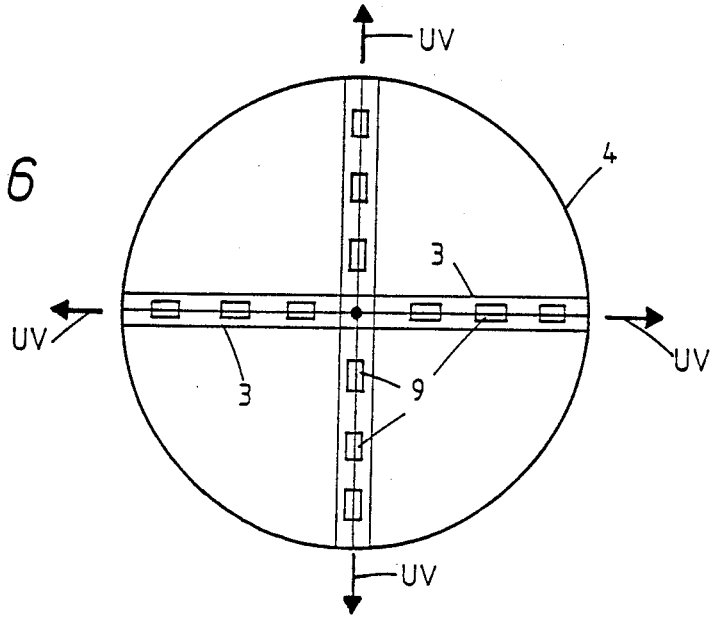
Figure 7:
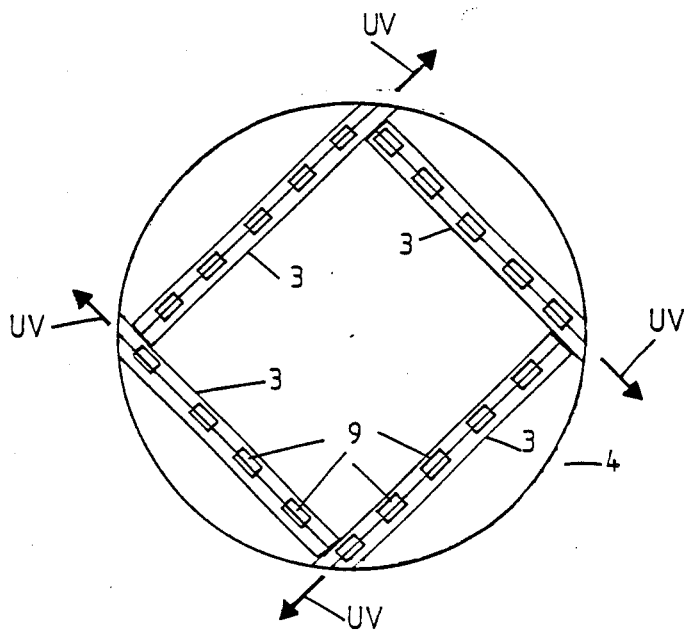

Body 2 can be a straight tubular girder, whereby housing 3 has naturally a corresponding shape. Naturally in certain cases wherein, for example, there is not much space available outside a flue-gas flow duct, the body 2 can be designed arcuately whereby, in a withdrawn position, body 2 arches substantially in the direction of wall 4. Thus, housing 3 must be designed into a corresponding shape. Also body 2 can be made of two components which are fitted inside a single-piece housing 3 from the side of the opposite walls of a flue-gas flow duct, the housing extending across the entire flow duct. The disposition of a straight housing 3 in a flow duct can also be planned in a manner that the space required outside will be minimized. FIGS. 5–7 illustrate a few possible dispositions for nozzle assemblies in a flow duct, particularly in a flow duct having a circular cross-section. FIG. 5 shows three parallel nozzle assemblies, the central one comprising a housing 3A, whose length is equal to the diameter of a flow duct and which includes two bodies that can be withdrawn in opposite directions from within the housing 3A (arrows UV). FIG. 6 shows four radially disposed nozzle assemblies 3, the body in each corresponding in length substantially to the radius of a flow duct. Naturally, there can be more than four nozzle assemblies. FIG. 7 shows an alternative, wherein the nozzle assemblies are set in an inclined position relative to radial direction.

We claim:

1. A nozzle assembly, comprising:

at least one nozzle for spraying a liquid moistening medium into a flow of flue gas;

means for passing the moistening medium to said nozzle; said nozzle and said means for passing the moistening medium being substantially disposed in a flue-gas flow duct, and enclosed in a housing;

an aperture provided in said housing for directing a jet of moistening medium issuing from said nozzle into a flow of flue gas;

wherein said nozzle and said means for passing the moistening medium are movably disposed within said housing and substantially removable from within said housing to the outside of said flue-gas flow duct; and a closing means for closing said aperture when said nozzle and said means for passing medium are removed from within said housing.

2. A nozzle assembly as set forth in claim 1, wherein the operation of said closing means is effected by a member, which is connected to said closing means and which can be manipulated from outside said flue-gas flow duct for closing and opening action.

3. A nozzle assembly according to claim 1, wherein said means for passing medium comprises an elongated tubular member.

4. A nozzle assembly as set forth in claim 3, wherein the operation of said closing means is linked with movement of said nozzle and said means for passing medium, relative to said housing, whereby a member fitted in said nozzle and/or said means for passing medium, shifts said closing means between an opened and closed position.

5. A nozzle assembly as set forth in claim 3, wherein the operation of said closing means is effected by a member, which is connected to said closing means and which can be manipulated from outside said flue-gas flow duct for closing and opening action.

6. A nozzle assembly as set forth in claim 3, comprising a plurality of nozzles positioned in said elongated tubular member at predetermined intervals, wherein said tubular member comprises another aperture and closing means associated with said aperture for each of the nozzles, and wherein said housing is fastened at least at one point, to a side wall of said flue-gas duct and provided with a closeable opening through which said tubular member and said nozzles are removable from within said housing.

7. A nozzle assembly as set forth in claim 6, wherein said housing is supported on the opposite walls of said flue-gas flow duct, wherein at a junction of both walls is provided an opening, and wherein said tubular member, along with its nozzles is divided into at least two sections, whose combined length corresponds to the length of said housing, said sections being removable from within said housing through different openings in said housing.

8. A nozzle assembly as set forth in claim 3, wherein said closing means is fitted inside said housing.

9. A nozzle assembly as set forth in claim 8, wherein a jet coming from said nozzle is directed substantially in the direction of said flue-gas flow, said aperture comprising said closing means in said housing extending to said trailing edge.

10. A nozzle assembly as set forth in claim 1, wherein said closing means is positioned over said aperture and is movable between an opened and closed position relative to said housing.

11. A nozzle assembly as set forth in claim 10, wherein said closing means is fitted inside said housing.

12. A nozzle assembly as set forth in claim 10, wherein the operation of said closing means is linked with the movement of said nozzle and said means for passing medium relative to said housing, whereby a member fitted in said nozzle and/or body shifts said closing means to an opened or closed position.

13. A nozzle assembly as set forth in claim 10, wherein said closing means is fitted inside said housing.

14. A nozzle assembly as set forth in claim 13, wherein a jet coming from said nozzle is directed substantially in the direction of said flue-gas flow, said aperture comprising the closing means in housing extending to said trailing edge.

15. A nozzle assembly as set forth in claim 1, wherein the cross-sectional shape of said housing in a downstream direction is aerodynamically designed, whereby a contact zone of said flue-gas flow is substantially arcuate in shape and a trailing zone of the flue-gas flow has a shape tapering towards a trailing edge.

16. A nozzle assembly as set forth in claim 15, wherein the cross-sectional shape of said closing means substantially corresponds to that of said trailing zone.

17. A nozzle assembly as set forth in claim 15, wherein the cross-sectional shape of said closing means substantially corresponds to that of said trailing zone.

18. A nozzle assembly as set forth in claim 15, wherein the cross-sectional configuration of said housing includes between said contact zone and said trailing zone, substantially parallel side walls defining an intermediate zone.

19. A nozzle assembly as set forth in claim 18, wherein two opposite edges are positioned at a junction of said side walls and said trailing zone from the ends of said two opposite edges towards said trailing edge.

20. A nozzle assembly as set forth in claim 18, wherein two opposite edges are positioned at the junction of said side walls and said trailing zone and wherein said aperture flares within the area of said trailing zone from the ends of said edges towards said trailing edge.

21. A nozzle assembly as set forth in claim 18, wherein a jet coming from said nozzle is directed substantially in the direction of said flue gas flow, said aperture with said closing means in said housing extending to said trailing edge.

22. A nozzle assembly as set forth in claim 21, wherein two opposite edges are positioned at the junction of said side walls and said trailing zone and wherein said aperture flares within the area of said trailing zone from the ends of said edges towards said trailing edge.

23. A nozzle assembly as set forth in claim 21, wherein the cross-sectional shape of said closing means substantially corresponds to that of said trailing zone.

* * * * *